US012383055B1

(12) United States Patent
Yu

(10) Patent No.: US 12,383,055 B1
(45) Date of Patent: Aug. 12, 2025

(54) SINGLE-LEG HEIGHT-ADJUSTABLE TABLE WITH ROTATION AND HEIGHT-ADJUSTMENT FUNCTIONS

(71) Applicant: Umi Smartech Co., Ltd., Zhejiang (CN)

(72) Inventor: Bing Yu, Zhejiang (CN)

( * ) Notice: Subject to any disclaimer, the term of this patent is extended or adjusted under 35 U.S.C. 154(b) by 0 days.

(21) Appl. No.: 18/953,397

(22) Filed: Nov. 20, 2024

(30) Foreign Application Priority Data

Apr. 19, 2024 (CN) ..... 202420827274.7

(51) Int. Cl.

| | |
|---|---|
| ***A47B 13/02*** | (2006.01) |
| ***A47B 9/10*** | (2006.01) |
| ***A47B 9/20*** | (2006.01) |
| ***A47B 13/08*** | (2006.01) |

(52) U.S. Cl.
CPC ..... *A47B 13/023* (2013.01); *A47B 9/10* (2013.01); *A47B 9/20* (2013.01); *A47B 13/081* (2013.01); *A47B 13/088* (2013.01); *A47B 2013/024* (2013.01)

(58) Field of Classification Search
CPC ..... A47B 9/16; A47B 9/20; A47B 17/02; A47B 2200/0046; A47B 13/023; A47B 13/088; A47B 2013/024
USPC ..... 108/3, 147, 147.11, 49
See application file for complete search history.

(56) References Cited

U.S. PATENT DOCUMENTS

| | | | | |
|---|---|---|---|---|
| 2,685,486 | A * | 8/1954 | Woller | A47B 23/046 108/3 |
| 2,742,336 | A * | 4/1956 | Holmberg | A47B 23/046 108/3 |
| 2,803,510 | A * | 8/1957 | Carbary | B60B 33/06 16/34 |
| 2,848,290 | A * | 8/1958 | Doty | A47B 23/046 108/4 |
| 3,259,432 | A * | 7/1966 | Jackson | A47C 7/006 248/129 |
| 5,144,898 | A * | 9/1992 | Posly | A47B 23/046 108/148 |
| 5,533,457 | A * | 7/1996 | Cox | A47B 13/023 100/150 |
| 6,089,666 | A * | 7/2000 | Rosko | A47D 1/00 297/463.2 |
| 6,694,891 | B1 * | 2/2004 | Lai | A47B 19/08 248/150 |
| 7,798,070 | B2 * | 9/2010 | Ooba | A47B 21/00 108/50.01 |
| 8,100,061 | B2 * | 1/2012 | Hookway | A47B 23/046 108/50.01 |
| 10,531,734 | B1 * | 1/2020 | Brauer | A47B 9/20 |
| 10,654,315 | B1 * | 5/2020 | Kamrowski | B60B 33/0047 |
| 11,129,471 | B1 * | 9/2021 | Oglesby | A47B 13/023 |
| 11,388,990 | B1 * | 7/2022 | Watkins | A63F 9/1044 |

(Continued)

*Primary Examiner* — Jose V Chen
(74) *Attorney, Agent, or Firm* — Hawaii Patent Services; Nathaniel K. Fedde; Kenton N. Fedde

(57) ABSTRACT

A single-leg height-adjustable table with rotation and height-adjustment functions comprise a table frame comprising a crossbar; a side tabletop fixed on the crossbar, a turnover tabletop rotatably connected with the crossbar, an angle adjuster comprising a first base and a gas spring connected with the first base; wherein the first base is fixed on the bottom surface of the turnover tabletop, and one end of the gas spring is rotatably connected with the crossbar.

20 Claims, 6 Drawing Sheets

(56) References Cited

U.S. PATENT DOCUMENTS

| | | | | |
|---|---|---|---|---|
| 11,533,989 | B1 * | 12/2022 | Haroutunian | A47B 85/06 |
| 2003/0094123 | A1 * | 5/2003 | Ulmer | A47B 13/023 108/10 |
| 2015/0257528 | A1 * | 9/2015 | Rosing | A47B 23/046 108/3 |
| 2016/0008070 | A1 * | 1/2016 | Choudhury | A47B 9/20 108/106 |
| 2017/0027314 | A1 * | 2/2017 | Guzman | A47B 13/14 |
| 2018/0125227 | A1 * | 5/2018 | Xiang | A47B 97/00 |
| 2018/0125233 | A1 * | 5/2018 | Leier | A47B 13/088 |
| 2019/0357671 | A1 * | 11/2019 | Duerstock | A47B 9/16 |
| 2020/0305595 | A1 * | 10/2020 | Lin | A47B 3/0815 |
| 2021/0068531 | A1 * | 3/2021 | Tao | A47B 13/003 |
| 2021/0100356 | A1 * | 4/2021 | Huang | A47B 17/03 |
| 2023/0072848 | A1 * | 3/2023 | Lu | A47B 3/002 |
| 2023/0248141 | A1 * | 8/2023 | Davis | A47B 23/046 108/144.11 |
| 2024/0130519 | A1 * | 4/2024 | Simon | A47B 13/023 |
| 2024/0365973 | A1 * | 11/2024 | Davis | A47B 9/20 |

* cited by examiner

SINGLE-LEG HEIGHT-ADJUSTABLE TABLE WITH ROTATION AND HEIGHT-ADJUSTMENT FUNCTIONS

CROSS-REFERENCE TO RELATED APPLICATIONS

This application claims the priority of China Patent Application No. 202420827274.7 filed on Apr. 19, 2024, entitled "Novel single-leg Height-Adjustable Table with Rotation and Height-adjustment Functions", and all the contents of the above application and its amendments are incorporated into this application by reference.

TECHNICAL FIELD

The present disclosure relates to that technical field of height-adjustable table, in particular to a single-leg height-adjustable table with a rotation and height-adjustment functions.

BACKGROUND

Tables usually include table boards and legs fixed together, which are difficult to store. Therefore, in recent years, some tables that can be deformed, overturned and folded have appeared, which can improve the convenience of table use.

For example, the existing U.S. Pat. No. 9,138,051 discloses a "Desk structure with adjustable angle". The patented tabletop can be folded.

However, the folding storage structure of the desktop in this patent is complex, which is difficult to control for children and the elderly.

Therefore, there is a need to propose a new type of rotatable table, which can facilitate people to control its deformation and improve the convenience of use.

SUMMARY

The present disclosure provides a single-leg height-adjustable table with a rotation and height-adjustment functions, which aims to solve that problem that the folding and accommodating structure of the tabletop of the exist foldable table is complex and difficult to control for children and the elderly.

In order to achieve the above object, the present disclosure provides a single-leg height-adjustable table with rotation and height-adjustment functions, which includes a single-leg height-adjustable table with rotation and height-adjustment functions, including: a table frame comprising a crossbar; a side tabletop fixed on the crossbar; a turnover tabletop rotatably connected with the crossbar; and an angle adjuster comprising a first base and a gas spring connected with the first base; the first base is fixed on a bottom surface of the turnover tabletop, and one end of the gas spring is rotatably connected with the crossbar; and when the gas spring is extended or shortened, the turnover tabletop is overturned.

The present disclosure further provides a single-leg height-adjustable table with rotation and height-adjustment functions, which includes a table frame; the table frame includes a crossbar, and at least one turnover tabletop is rotatably mounted on the crossbar; an angle adjuster is disposed between the turnover tabletop and the crossbar; the angle adjuster has at least one telescopic part which is telescopic and can keep a rotation angle; and the telescopic part is rotatably connected between the turnover tabletop and the crossbar; when the telescopic part is extended or shortened, the turnover tabletop is overturned.

The present disclosure further provides a single-leg height-adjustable table with rotation and height-adjustment functions, comprising a table frame; the table frame includes a crossbar, and at least one turnover tabletop is rotatably mounted on the crossbar; an angle adjuster is disposed between the turnover tabletop and the crossbar; the angle adjuster includes a first base and a gas spring connected with the first base; the first base is fixed on a bottom surface of the turnover tabletop, and one end of the gas spring is rotatably connected with the crossbar; when the gas spring is extended or shortened, the turnover tabletop rotates; the single-leg height-adjustable table further includes a telescopic table leg, wherein an upper end of the telescopic table leg is provided with a second base, and the telescopic table leg is connected with the crossbar by the second base.

Figure 1:
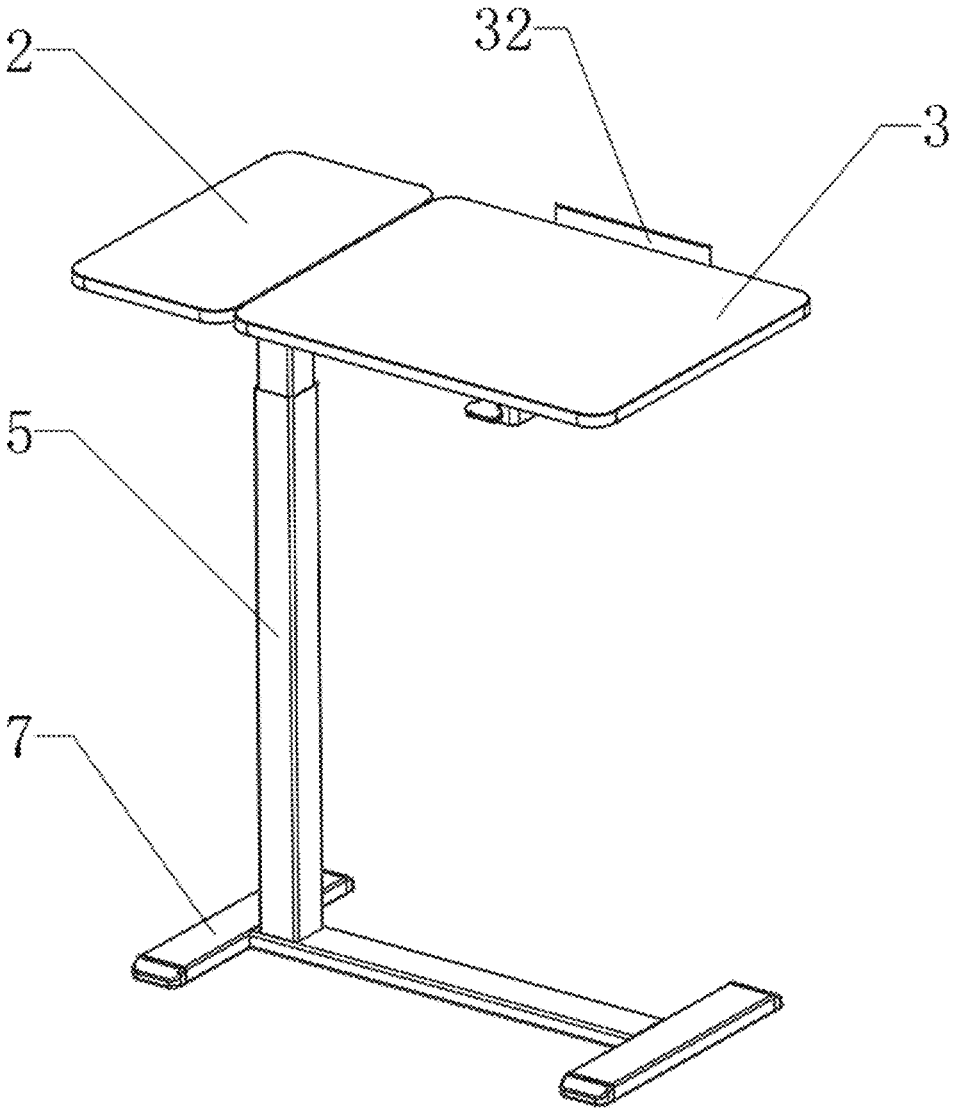
FIG. 1 is a schematic structural diagram of the present disclosure.

Reference signs: crossbar (1); Side tabletop (2); Turnover tabletop (3); Hinge (31); Blocking plate (32); Angle adjuster (4); First base (41); Gas spring (42); First adjusting handle (43); Telescopic table leg (5); Second base (6); Second adjusting handle (61); Table base (7); Caster wheel (71); First rotation end joint (8); Second rotation end joint (9); Angle adjusting seat (10).

DESCRIPTION OF EMBODIMENTS

Please refer to FIG. 1 to FIG. 6:

The present disclosure provides a single-leg height-adjustable table with a with rotation and height-adjustment functions, which includes a table frame, on which a tabletop is mounted. The table frame includes a crossbar 1 at the uppermost end. The tabletop includes a side tabletop 2 and a turnover tabletop 3, the side tabletop 2 is fixed on the crossbar 1, and the turnover tabletop 3 is rotatably connected with the crossbar 1. The side tabletop 2 and the turnover tabletop 3 can be spliced and abutted to form a tabletop with a complete appearance for users to use.

Figure 2:
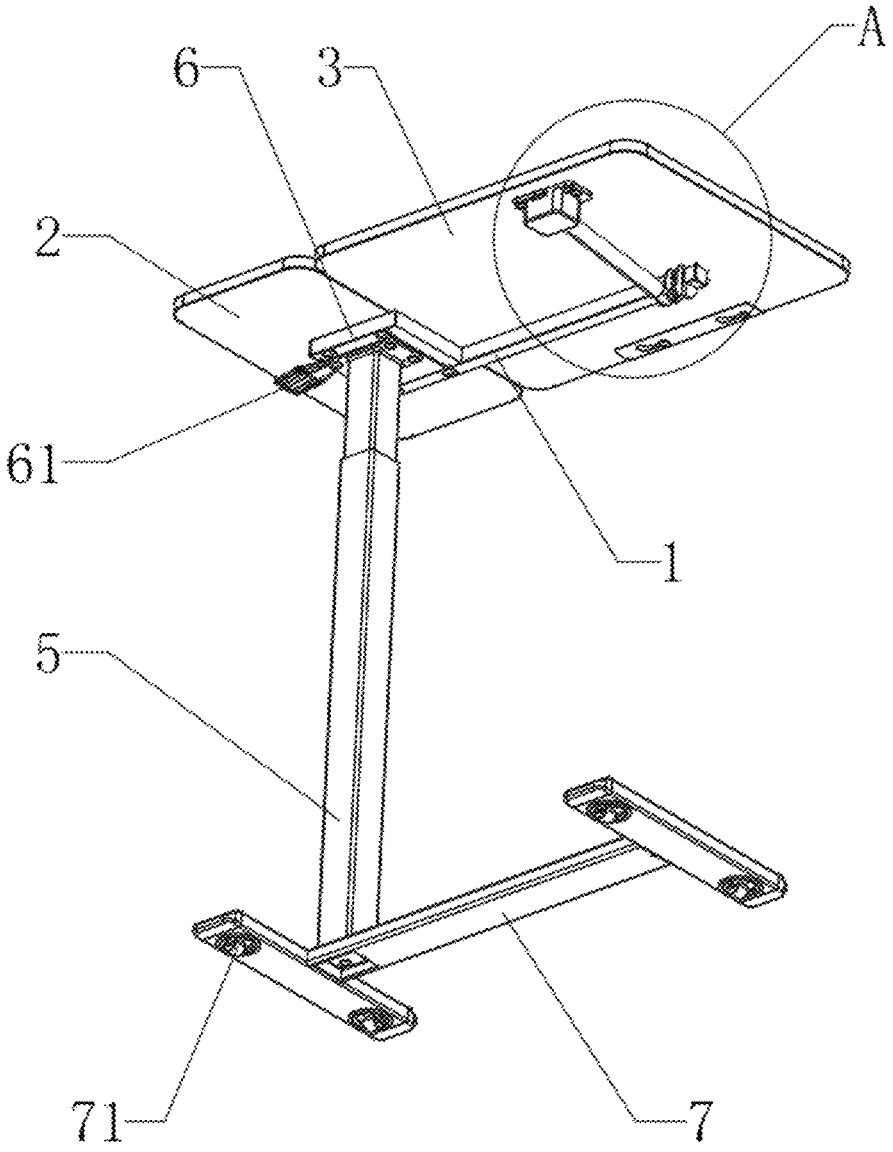
FIG. 2 is a schematic structural view from another perspective of FIG. 1.

In this embodiment, as shown in FIGS. 1 and 2, the crossbar 1 is used to support the side tabletop 2 and the turnover tabletop 3, so as to maintain the horizontal alignment and stable connection between them when the table is in use, and form a coherent and seamless overall working plane. This method not only ensures the stability and structural strength of the tabletop in use, but also significantly improves the comfort of users by reducing the unevenness or shaking between tabletops. In addition, this supporting structure further optimizes the space utilization efficiency, makes the tabletop conversion more flexible and convenient, and meets the use requirements in different scenarios, thus improving the user experience as a whole.

In order to improve the stability of splicing between the side tabletop 2 and the turnover tabletop 3, in other embodiments (not shown), locks such as snaps, buckles, plug-in locks, electronic latches and the like can also be disposed between the side tabletop 2 and the turnover tabletop 3. Therefore, when the side tabletop 2 and the turnover tabletop 3 are spliced into a whole tabletop, the side tabletop 2 and the turnover tabletop 3 are fixed through the locks, so that the splicing stability can be improved and the turnover tabletop 3 can be prevented from shaking or being jerky.

Figure 3:
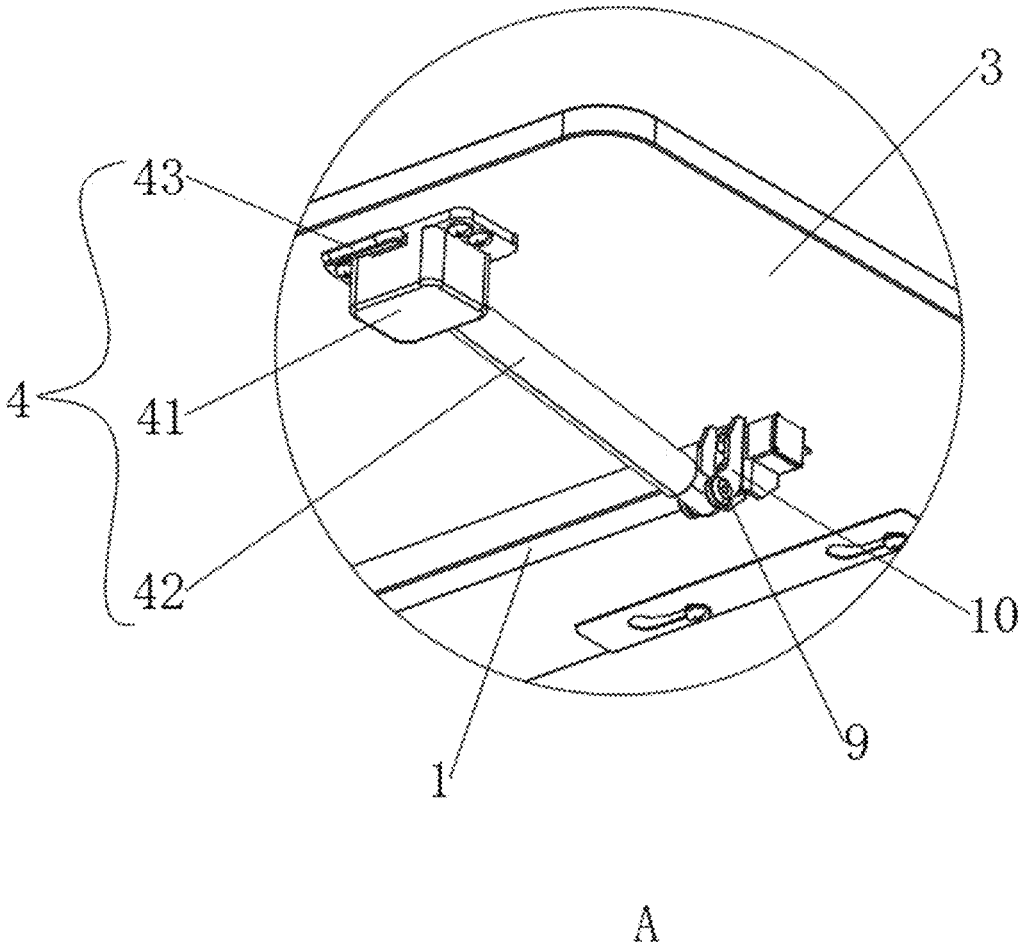
FIG. 3 is a partially enlarged schematic view at a of FIG. 2.

In this embodiment, as shown in FIG. 3, an angle adjuster 4 is connected between the crossbar 1 and the turnover tabletop 3. The angle adjuster 4 includes a first base 41 and a gas spring 42 which is rotatably connected with the first base 41. The base is fixed at the bottom of the turnover tabletop 3, and one end of the gas spring 42 is rotatably connected with the crossbar 1. The gas spring 42 can expand and contract, and can be automatically maintained at the length after expansion or contraction when being applied with a load. The gas spring 42 is a well-known technology, and the principle of expansion and contraction of the gas spring 42 will not be described in detail in this application.

Figure 5:
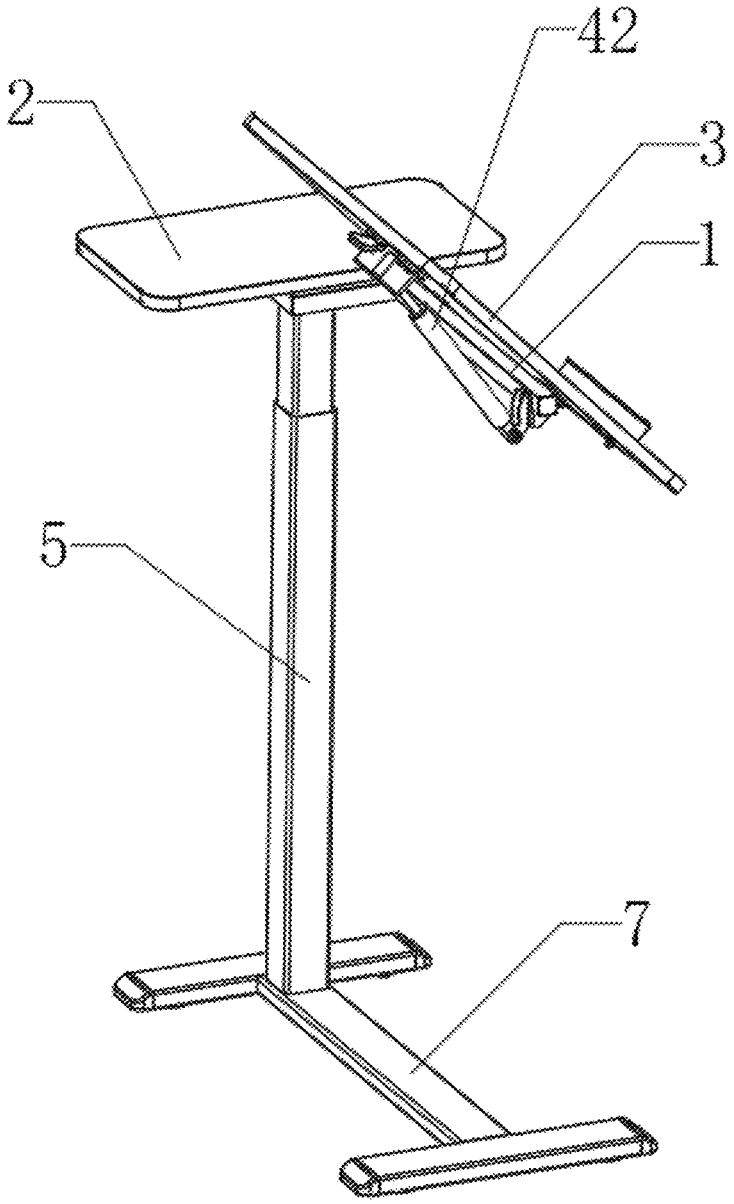
FIG. 5 is a state diagram when the present disclosure is turned over.
Figure 6:
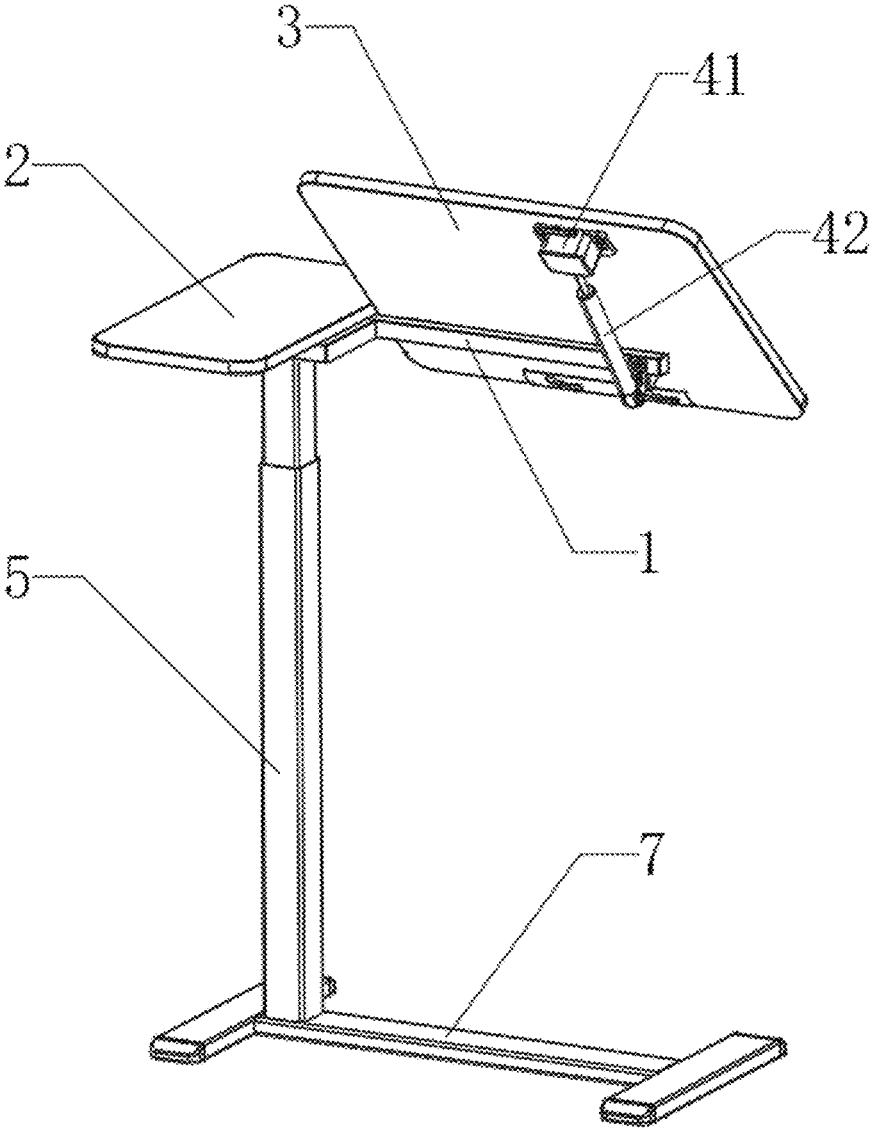
FIG. 6 is a schematic structural view from another perspective of FIG. 5.

Therefore, by disposing the telescopic gas spring 42, the turnover tabletop 3 can be pushed to overturn, so that the turnover tabletop 3 can be overturned in an inclined, vertical or horizontal state, as shown in FIGS. 5 and 6. Moreover, the unique rapid and accurate expansion and contraction performance of the gas spring 42 is utilized, which greatly promotes the fluency and efficiency of the folding and overturning operations of the tabletop, and is suitable for children, the elderly and the user groups who need to adjust the tabletop frequently, thus greatly improving the convenience. This method not only improves the traditional tabletop adjustment mode, but also improves the user's comfortable feeling and operating comfort by reducing the physical labor intensity. Moreover, the stability and safety of the tabletop in different states are ensured by the gas spring 42.

Figure 4:
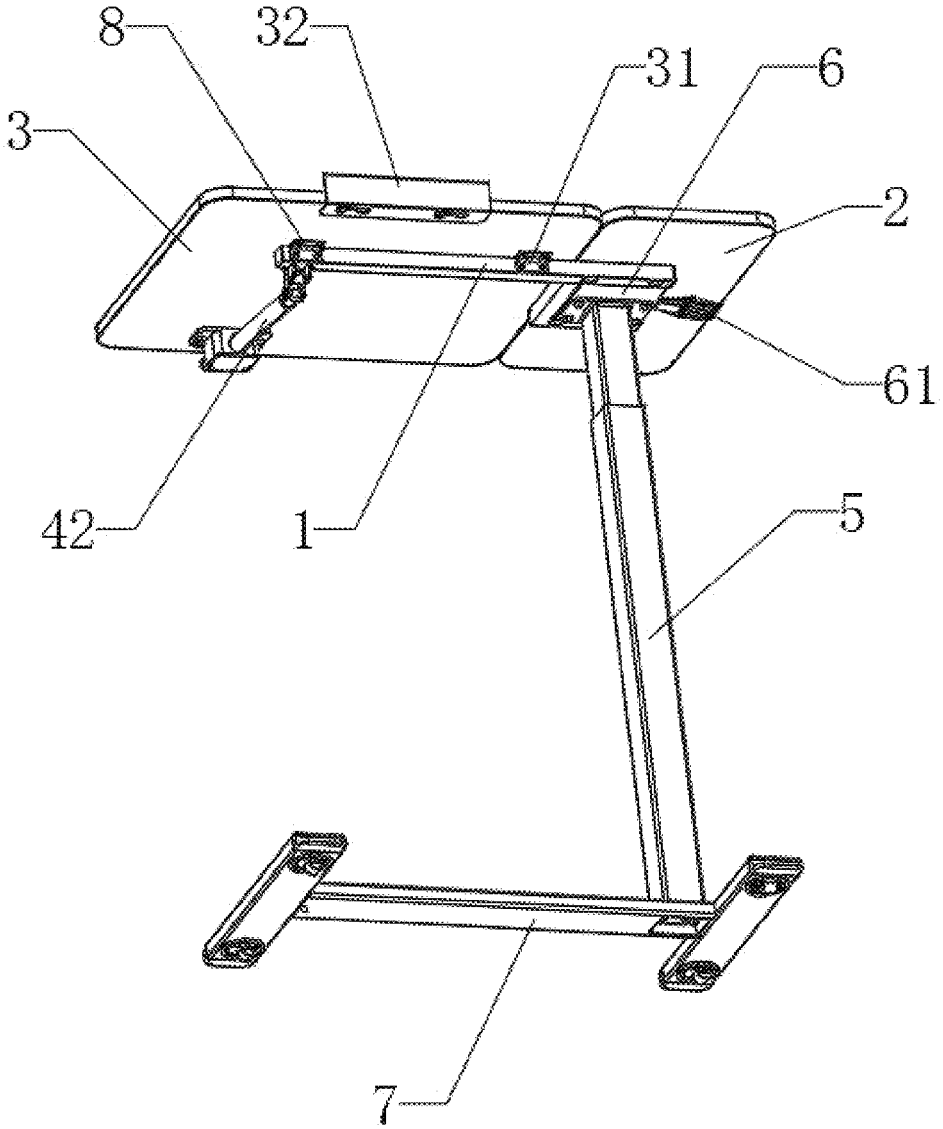
FIG. 4 is a schematic structural view from another perspective of FIG. 1.

In order to achieve the above object, in this embodiment, as shown in FIGS. 3 and 4, the connecting end of the turnover tabletop 3 and the crossbar 1 is a first rotation end joint 8, and the connecting end of the gas spring 42 and the crossbar 1 is a second rotation end joint 9. There is a distance between the first rotation end joint 8 and the second rotation end joint 9, and the first base 41 and the second rotation end joint 9 are spaced apart with an adjustable spacing. Therefore, when the gas spring 42 is extended, the turnover tabletop 3 rotates around the first rotation end joint 8, and the gas spring 42 rotates around the second rotation end joint 9. The turnover tabletop 3 is rotatably connected with the crossbar 1 by the hinges 31, and the side surface of the crossbar 1 and the bottom surface of the turnover tabletop 3 are configured to be flat for the hinges 31 to be installed. The turnover tabletop 3 can rotate around the crossbar 1 through the hinges 31, and the gas spring 42 can smoothly push the turnover tabletop 3 to turn over through the matched configuration of the first rotation end joint 8 and the second rotation end joint 9.

The rotary connection between the turnover tabletop 3 and the crossbar 1 is not limited to the connection by hinges 31, and in other embodiments (not shown), advanced rotary connection modes such as hinge connection, pin shaft connection and rotating shaft connection can also be adopted. Hinge connection has excellent stability and durability, which is suitable for occasions that need to bear heavy load or rotate frequently. Pin connection is suitable for lightweight and reducing the cost-effectiveness of processing and manufacturing because of its simple structure and easy maintenance. Rotating shaft connection is smoother, which is suitable for occasions with higher requirements for rotation. By providing this diversified rotation connection mode, the rotation mode of the turnover tabletop 3 is more flexible and configurable, so that users can choose the most suitable rotation connection solution according to different use occasions, functional requirements and aesthetic preferences, thereby enhancing the universality and market competitiveness of products.

Furthermore, it has been mentioned that the first rotation end joint 8 and the second rotation end joint 9 are space apart with a certain spacing, which refers to the diagonal length of the rectangular cross section of the crossbar 1. If the spacing is too short, the size of the gas spring 42 is required to be high, and it may be difficult to purchase the conventional gas spring 42 that meets the requirements. Therefore, an angle adjusting seat 10 is added to the crossbar 1, and one end of the gas spring 42 is hinged to the angle adjusting seat 10 so as to be rotationally connected with the crossbar 1. The angle adjusting seat 10 extends the spacing between the first rotation end joint 8 and the second rotation end joint 9, so that the size requirement for the gas spring 42 is reduced, which is in line with the actual use situation.

In this embodiment, as shown in FIG. 3, the angle adjusting seat 10 is a groove structure, which not only provides great convenience for the installation of the gas spring 42, but also ensures the accuracy and stability of the installation. The groove structure enables the gas spring 42 to be easily embedded and fixed at a predetermined position, thus effectively supporting the multi-angle adjustment of the turnover tabletop 3 and meeting the needs of users in different usage scenarios.

In other possible embodiments (not shown), the angle adjusting seat 10 may also be a connecting rod structure, and the connecting rod structure may also be set to be telescopic. With the telescopic connecting rod structure, the user is allowed to freely adjust the length of the angle adjusting seat 10 within a certain range, thus realizing fine adjustment of the height of the tabletop. This function meets the individual needs of users with different heights, and at the same time, the telescopic property of the connecting rod structure also enhances the adaptability and durability of the table, so that it can be better adapted for various complex use environments.

Of course, the angle adjusting seat 10 can also be configured in other shapes (not shown), such as an L-shape or any other shape adapted for the installation or rotation of the gas spring 42.

In this embodiment, the first base 41 includes a first adjusting handle 43, and the user can control the extension or shortening of the gas spring 42 by manipulating the first adjusting handle 43. The first base 41 has structures and components related to pneumatic control, which are in the prior art and will not be described here.

In other embodiments (not shown), the gas spring 42 may also be replaced by other telescopic parts, such as an electric telescopic rod. The motor and transmission mechanism are integrated in the electric telescopic rod, and the fast and stable telescopic action can be realized by external power supply, so that the turnover tabletop 3 can be overturned in an electric way, which not only simplifies the operation flow of users, but also significantly improves the accuracy and stability of overturning. With the use of the electric telescopic rod, the overturning and folding process of the tabletop becomes more convenient and efficient. The user can control the expansion and contraction of the electric telescopic rod only by simple key operation to drive the turnover tabletop 3 for angle adjustment or to be completely folded. This method not only meets the user's demand for tabletop flexibility, but also improves the overall experience by reducing the complexity of manual operation.

As shown in FIG. 1, FIG. 2 and FIG. 3, in this embodiment, the table frame further includes a telescopic table leg 5 and a table base 7. The table base 7 abuts against the ground, the telescopic table leg 5 is connected with the table base 7. The upper end of the telescopic table leg 5 is connected with the crossbar 1 through a second base 6, which includes a second adjusting handle 61 capable of controlling the extension or shortening of the telescopic table leg 5, thereby controlling the height of the tabletop.

In this embodiment, the telescopic table legs 5 also extend and retract in a pneumatic way, and the second base 6 has structures and components related to pneumatic control, which are in the prior art and will not be described in detail here.

In other embodiments (not shown), the telescopic table leg 5 can also be extended and retracted by electric means, or a lead screw extension mechanism can be used instead. In this way, the appropriate telescoping mode can be selected according to different application scenarios.

In this embodiment, a hidden caster wheel 71 is connected with the lower end face of the table base 7. A blocking plate 32 is provided at the upper end of the side of the turnover tabletop 3 far from the first base 41.

By disposing the hidden caster wheel 71, the appearance is beautiful and the caster wheel 71 can be prevented from being damaged by collision. By disposing the blocking plate 32, when the turnover tabletop 3 is overturned, articles on the tabletop are easy to slide down, therefore the blocking plate 32 is added to prevent articles from sliding down and falling to the ground.

In this embodiment, as shown in FIG. 3, the blocking plate 32 is fixedly connected with the turnover tabletop 3 by bolts, so that the connection of the blocking plate 32 is more stable.

In other possible embodiments of the blocking plate 32 (not shown), the blocking plate 32 and the turnover tabletop 3 can also be connected in a telescopic manner. For example, an accommodating slot is formed on the turnover tabletop 3, and the blocking plate 32 is inserted into the accommodating slot and slidably connected with the storage slot. When the blocking plate 32 needs to be used, a part of the blocking plate 32 can be pulled out of the accommodating slot to fold the edge of the turnover tabletop 3. When not in use, the blocking plate 32 can be retracted into the storage slot for accommodation. In this way, when the turnover tabletop 3 is folded, the blocking plate 32 will not affect the folding of the turnover tabletop 3, so that the space can be fully utilized and the tabletop of the table can be more beautiful.

The working principle of the present disclosure is as follows:

a rotatable turnover tabletop 3 is installed on a crossbar 1, and an angle adjuster 4 with a gas spring 42 is installed between the crossbar 1 and the side tabletop 2; wherein one end of the gas spring 42 is mounted on the crossbar 1 and is capable of rotation; when the gas spring 42 is extended, one end of the turnover tabletop 3 is lifted up, so that the purpose of rotating and accommodating the tabletop is realized; and the angle adjuster 4 is close to the lower end of the turnover tabletop 3 as a whole, so that the structure is compact and does not affect the placement of legs of users.

What is claimed is:

1. A single-leg height-adjustable table with rotation and height-adjustment functions, comprising:

a table frame comprising a crossbar;

a side tabletop fixed on the crossbar;

a turnover tabletop rotatably connected with the crossbar by a first rotation end joint; and an angle adjuster comprising a first base and a gas spring connected with the first base;

wherein the first base is fixed on a bottom surface of the turnover tabletop, and one end of the gas spring is rotatably and connected with the crossbar by a second rotation end joint; and wherein when the gas spring is extended or shortened, the turnover tabletop is tilted relative to the side tabletop;

wherein the single-leg height-adjustable table with rotation and height-adjustment further comprises an angle adjusting seat, wherein the crossbar is connected with the angle adjusting seat by the first rotation end joint, and the end of the gas spring is hinged on the angle adjusting seat by the second rotation end joint, the angle adjusting seat is configured to provide spacing between the first rotation end joint and the second rotation end joint.

2. The single-leg height-adjustable table with rotation and height-adjustment functions according to claim 1, wherein the first rotation end joint comprises hinges.

3. The single-leg height-adjustable table with rotation and height-adjustment functions according to claim 1, wherein the first base further comprises a first adjusting handle configured for extending or shortening the gas spring.

4. The single-leg height-adjustable table with rotation and height-adjustment functions according to claim 1, wherein the table frame further comprises a telescopic table leg and a table base, and the telescopic table leg is connected with the table base.

5. The single-leg height-adjustable table with rotation and height-adjustment functions according to claim 4, wherein an upper end of the telescopic table leg is provided with a second base, and the telescopic table leg is connected with the crossbar by the second base.

6. The single-leg height-adjustable table with rotation and height-adjustment functions according to claim 5, wherein the second base comprises a second adjusting handle configured for extending or shortening the telescopic table leg.

7. The single-leg height-adjustable table with rotation and height-adjustment functions according to claim 4, wherein a lower end face of the table base is connected with a hidden caster wheel.

8. The single-leg height-adjustable table with rotation and height-adjustment functions according to claim 1, wherein a blocking plate is disposed at an upper end of a side of the turnover tabletop away from the first base.

9. The single-leg height-adjustable table with rotation and height-adjustment functions according to claim 1, wherein the turnover tabletop makes contact with the crossbar to be supported thereby.

10. A single-leg height-adjustable table with rotation and height-adjustment functions, comprising a table frame comprising a crossbar, and at least one turnover tabletop rotatably mounted on the crossbar; and an angle adjuster disposed between the at least one turnover tabletop and the crossbar, wherein the angle adjuster comprises at least one telescopic part telescopically extendable and contractable;

the at least one telescopic part is rotatably connected between a corresponding turnover tabletop of the at least one turnover tabletop and the crossbar;

when the at least one telescopic part is extended or shortened, the corresponding turnover tabletop is tilted to change a rotation angle, and the at least one telescopic part is configured such that after expansion or shortening, a length of the at least one telescopic part is automatically maintained to maintain the rotation angle;

the at least one telescopic part is a gas spring, one end of the gas spring is rotatably and mounted on the crossbar; and wherein another end of the gas spring is provided with a first base attached to a side of the corresponding turnover tabletop facing the gas spring.

11. The single-leg height-adjustable table with rotation and height-adjustment functions according to claim 10, wherein the first base is provided with a first adjusting handle configured for extending or shortening the gas spring.

12. The single-leg height-adjustable table with rotation and height-adjustment functions according to claim 10, wherein the table frame further comprises a telescopic table leg and a table base, and the telescopic table leg is connected with the table base.

13. The single-leg height-adjustable table with rotation and height-adjustment functions according to claim 12, wherein an upper end of the telescopic table leg is provided with a second base, and the telescopic table leg is connected with the crossbar by the second base.

14. The single-leg height-adjustable table with rotation and height-adjustment functions according to claim 13, wherein the second base comprises a second adjusting handle configured to extending or shortening the telescopic table leg.

15. The single-leg height-adjustable table with rotation and height-adjustment functions according to claim 10, wherein the at least one turnover tabletop makes contact with the crossbar to be supported thereby.

16. A single-leg height-adjustable table with rotation and height-adjustment functions, comprising a table frame comprising a crossbar, and at least one turnover tabletop rotatably mounted on the crossbar by a first rotation end joint; and an angle adjuster disposed between the at least one turnover tabletop and the crossbar;

and comprising a first base and a gas spring connected with the first base, wherein the first base is fixed on a bottom surface of the at least one turnover tabletop, and one end of the gas spring is rotatably and connected with the crossbar by a second rotation end joint;

when the gas spring is extended or shortened, the at least one turnover tabletop rotates;

the single-leg height-adjustable table further comprises a telescopic table leg, wherein an upper end of the telescopic table leg is provided with a second base, and the telescopic table leg is connected with the crossbar by the second base;

the crossbar comprises an angle adjusting seat, the crossbar is connected with the angle adjusting seat by the first rotation end joint, and the end of the gas spring is hinged on the angle adjusting seat by the second rotation end joint, the angle adjusting seat is configured to provide spacing between the first rotation end joint and the second rotation end joint.

17. The single-leg height-adjustable table with rotation and height-adjustment functions according to claim 16, wherein the second base comprises a second adjusting handle configured for extending or shortening the telescopic table leg.

18. The single-leg height-adjustable table with rotation and height-adjustment functions according to claim 17, wherein the table frame further comprises a table base, and the telescopic table leg is connected with the table base.

19. The single-leg height-adjustable table with rotation and height-adjustment functions according to claim 18, wherein a lower end face of the table base is connected with a hidden caster wheel.

20. The single-leg height-adjustable table with rotation and height-adjustment functions according to claim 16, wherein the at least one turnover tabletop makes contact with the crossbar to be supported thereby.

* * * * *